US010072829B1

(12) United States Patent
Christ et al.

(10) Patent No.: US 10,072,829 B1
(45) Date of Patent: Sep. 11, 2018

(54) PORTABLE LIGHT

(71) Applicants: James Richard Christ, Peachtree City, GA (US); Christopher Michael Bryant, Social Circle, GA (US)

(72) Inventors: James Richard Christ, Peachtree City, GA (US); Christopher Michael Bryant, Social Circle, GA (US)

(73) Assignee: Cooper Technologies Company, Houston, TX (US)

( * ) Notice: Subject to any disclaimer, the term of this patent is extended or adjusted under 35 U.S.C. 154(b) by 30 days.

(21) Appl. No.: 15/087,135

(22) Filed: Mar. 31, 2016

Related U.S. Application Data

(60) Provisional application No. 62/288,909, filed on Jan. 29, 2016.

(51) Int. Cl.

| | |
|---|---|
| ***F21L 4/00*** | (2006.01) |
| ***F21V 21/30*** | (2006.01) |
| ***F21L 4/02*** | (2006.01) |
| ***F21V 21/14*** | (2006.01) |
| ***F21V 9/00*** | (2018.01) |
| ***F21V 5/00*** | (2018.01) |
| *F21Y 101/02* | (2006.01) |

(52) U.S. Cl.
CPC ..... *F21V 21/30* (2013.01); *F21L 4/02* (2013.01); *F21V 5/006* (2013.01); *F21V 9/00* (2013.01); *F21V 21/145* (2013.01); *F21Y 2101/02* (2013.01)

(58) Field of Classification Search
CPC ..... F21V 21/30; F21V 5/006; F21V 21/145; F21V 9/00; F21L 4/02; F21Y 2101/02
USPC ..... 362/190
See application file for complete search history.

(56) References Cited

U.S. PATENT DOCUMENTS

| | | | |
|---|---|---|---|
| D372,997 | S | 8/1996 | Meoli |
| D505,217 | S | 5/2005 | Bayat |
| 7,121,688 | B2 | 10/2006 | Rempel |
| D546,490 | S | 7/2007 | Brown |
| D550,385 | S | 9/2007 | Hamilton |
| D588,733 | S | 3/2009 | O'Hern |
| D593,695 | S | 6/2009 | Levine |
| D636,915 | S | 4/2011 | Bryant |
| D638,153 | S | 5/2011 | Christ |
| 7,954,980 | B2 | 6/2011 | Bryant et al. |
| 8,303,142 | B2 | 11/2012 | Bryant et al. |
| 8,430,529 | B2 | 4/2013 | Christ |
| 8,721,120 | B2 | 5/2014 | Christ et al. |
| 9,046,231 | B2 | 6/2015 | Christ et al. |
| D750,822 | S | 3/2016 | Hernandez |

(Continued)

*Primary Examiner* — Tsion Tumebo
(74) *Attorney, Agent, or Firm* — King & Spalding LLP

(57) ABSTRACT

A lighting system, for example a portable light, can have at least two configurations that support outputting illumination in at least two different patterns. The lighting system can incorporate at least two light emitting diodes and at least two optics, for example two diffusing lenses or filters. In a first configuration, the light emitting diodes can emit light that provides illumination without incidence on the optics. In a second configuration, the light emitting diodes can emit light that is incident upon and controlled by the optics. Changing between the first and second configurations can move the optics into the respective light paths of the light emitting diodes.

19 Claims, 12 Drawing Sheets

(56) References Cited

U.S. PATENT DOCUMENTS

| | | | | |
|---|---|---|---|---|
| 9,625,125 | B1 * | 4/2017 | Bryant et al. | D26/49 |
| 2006/0034078 | A1 * | 2/2006 | Kovacik | F21L 4/08<br>362/227 |

* cited by examiner

PORTABLE LIGHT

CROSS REFERENCE TO RELATED APPLICATIONS

This application claims priority to U.S. Provisional Patent Application No. 62/288,909 filed Jan. 29, 2016 in the name of James Richard Christ and Christopher Michael Bryant and entitled "Portable Light," the entire contents of which are hereby incorporated herein by reference.

TECHNICAL FIELD

Embodiments of the technology relate generally to lighting systems and more specifically to a portable luminaire that is useful as a work light and that may have two or more configurations.

BACKGROUND

For illumination applications, light emitting diodes (LEDs) offer substantial potential benefit associated with their energy efficiency, light quality, and compact size. However, to realize the full potential benefits offered by light emitting diodes, new technologies are needed.

For instance, there are needs in the art for portable lighting systems that realize or leverage the potential benefits offered by light emitting diodes. For example, need exists for a portable light that can produce different illumination patterns to meet different user situations and applications. Further need exists for a portable light that has two or more configurations, to provide application flexibility. A capability addressing one or more such needs, or some other related deficiency in the art, would support improved illumination systems and more widespread utilization of light emitting diodes in lighting applications.

SUMMARY

In one aspect of the disclosure, a lighting system can provide two or more configurations. The lighting system can comprise a portable light or a task light, for example. The lighting system can provide different illumination patterns in the two or more configurations. For example, the portable lighting system can provide relatively narrow directional illumination in one configuration and diffuse, spread illumination in another configuration.

In one aspect of the disclosure, the lighting system can comprise at least one light emitting diode and at least one optic. In one configuration of the lighting system, the light emitting diode can emit light that forms an illumination pattern without utilizing the optic for light management. In another configuration of the lighting system, the optic can manage the light emitted by the light emitting diode. In some examples, the optic can move into or out of the light path of the light emitting diode when the configuration of the lighting system changes.

In some examples, the optic can comprise a diffuse lens. In some examples, the optic can comprise a refractive element. In some examples, the optic can comprise a color filter. In some examples, the lighting system can comprise two light emitting diodes and two corresponding optics, with the two optics respectively moving in front of the two light emitting diodes as the lighting system is reconfigured.

The foregoing discussion is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

BRIEF DESCRIPTION OF THE FIGURES

Reference will be made below to the accompanying drawings.

Figure 1A:
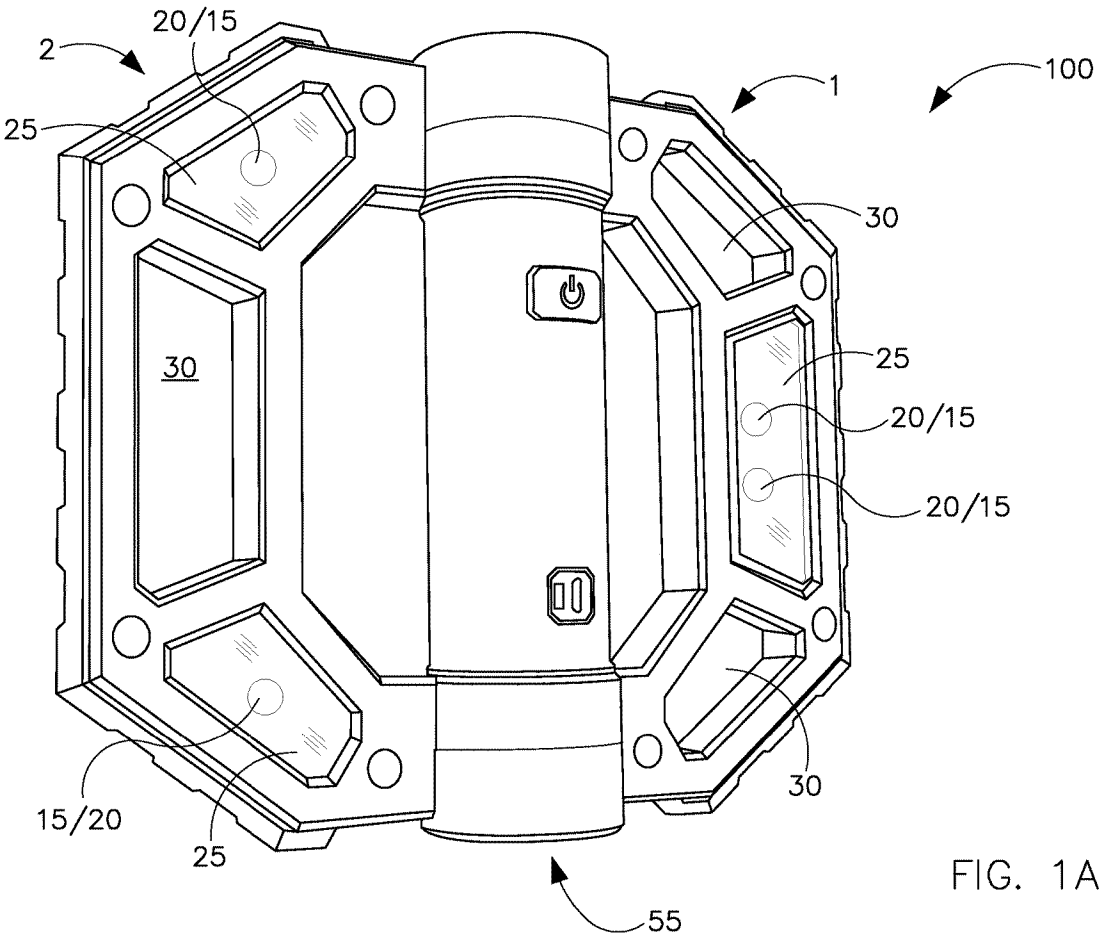
FIGS. 1A, 1B, 1C, and 1D (collectively FIG. 1) illustrate an example portable light in accordance with some embodiments of the disclosure.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements.

DESCRIPTION OF EXAMPLE EMBODIMENTS

In accordance with some representative embodiments of the disclosure, a lighting system, for example a portable task light or a portable work light, can provide different illumination patterns as may be appropriate or called for by different tasks or projects. The different illumination patterns can be user-selectable and may correlate to different physical configurations of a portable light, for example.

In one configuration, the portable light can provide a directional beam of light for illuminating a work area or an opening that is recessed or narrow. In another configuration, the portable light can provide diffuse, low-glare light for reading or general area illumination that may be soft or that may avoid being harsh on a user's eyesight. A portable light that emits different illumination patterns can alleviate any inconvenience or impracticality of a user needing to carry multiple lights, such as a flashlight for directional lighting and a portable fixture that has a frosted lens or a frosted bulb mounted for diffuse lighting. In some example embodiments, the portable light can further be battery powered, thus accommodating work areas that may lack convenient or adequate electrical facilities for plug-in line power.

In some example embodiments, the portable light can comprise light emitting diode light sources containing optical elements, for example lenses. The light emitting diode light sources can be mounted to respective arms that rotate about a central axis of rotation, with complimentarily located diffuse lenses arranged around the same central axis of rotation. The light emitting diode light sources and the diffuse lenses can be arranged such that when a user rotates the arms to face each other, the portable light can assume a closed configuration. From this closed position, the light emitting diode light sources can direct light through the diffuse lenses to provide diffuse, glare-free illumination that emanates from the rotating arms.

When the user rotates the arms to a position in which the light emitting diode light sources are not facing each other, the portable light can assume an open position. From this open position, the light emitting diode light sources can direct light through the optical elements to provide directional beams or patterns of light. A user can aim or direct those beams or patterns of light based on an orientation. The orientation can be determined by a relative angle (or angles) formed by the arms with respect to the central axis of rotation. The resulting lighting can be well suited for appropriate task illumination applications.

Some representative embodiments will be further described hereinafter with example reference to the accompanying drawings that describe representative embodiments of the present technology. The technology may, however, be embodied in many different forms and should not be construed as limited to the embodiments set forth herein; rather, these embodiments are provided so that this disclosure will be thorough and complete, and will fully convey the scope of the technology to those appropriately skilled in the art.

As will be discussed in further detail below, the figures illustrate example portable lights. More specifically, FIGS. 1A, 1B, 1C, and 1D illustrate a first example embodiment of a portable light 100. FIGS. 2A, 2B, 2C, 2D, 2E, 2F, and 2G illustrate a second example embodiment of a portable light 200. FIGS. 3A, 3B, 3C, and 3D illustrate a third example embodiment of a portable light 300. In some example embodiments, the portable light 100 of FIG. 1 incorporates the optical configuration details of the portable light 300 illustrated in FIG. 3.

Referring now to FIG. 1, multiple views of the portable light 100 are provided. FIG. 1A illustrates a perspective view of the portable light 100 in an open configuration. FIGS. 1B and 1C respectively illustrate opposing side views of the portable light 100 in a closed configuration. FIG. 2D illustrates a cutaway perspective view of the portable light 100 in the closed configuration.

In the open configuration of FIG. 1A, the arms 1, 2 of the portable light 100 are open. The arms 1, 2 rotate about a central portion 55 of the portable light 100, which provides a central axis of rotation as discussed above. The central portion 55 further provides an enclosure for housing batteries and power controls, such as an on-off switch. The central portion 55 may be sized to accommodate one, two, three, four, or some other appropriate number of batteries. In some example embodiments, such batteries may be "C" or "D" sized or some other appropriate size. The central portion 55 may further be sized for holding or grasping in a hand of a user, for example.

In the open configuration illustrated in FIG. 1A, the portable light 100 emits directional light that may be concentrated to illuminate a relatively narrow space or to project light a relatively large distance, for example. The light emitting diodes 15, which are illustrated as mounted on printed circuit boards (PCBs), emit light that is incident upon focusing optical elements 20 and associated reflectors 35. The focusing optical elements 20, which can comprise refractive lenses for example, and the reflectors 35 direct, condense, collimate, or focus the light emitted by the light emitting diodes 15. The resulting illumination passes through a clear lens 25, which can comprise a flat plastic or glass window that is positioned adjacent the focusing optical elements 20 in some embodiments. Accordingly, the portable light 100 may emit light in a relatively tight pattern with the arms 1 and 2 open.

Figure 1C:
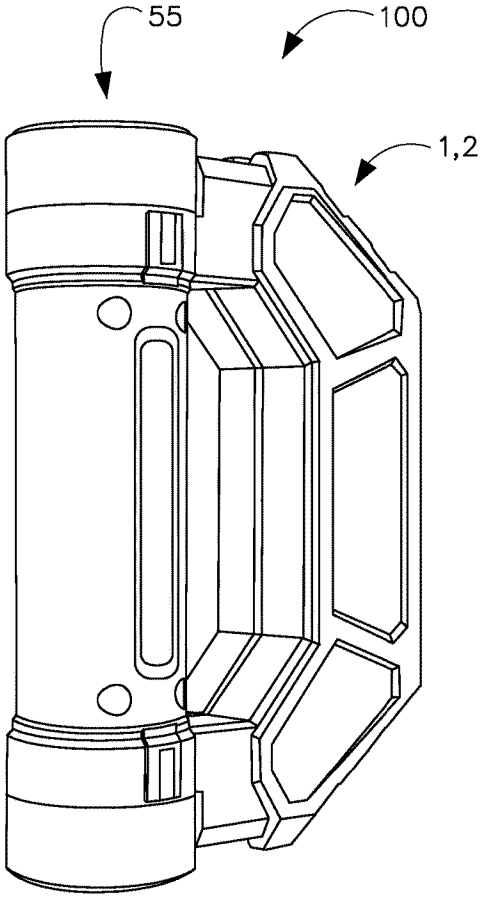
Figure 1B:
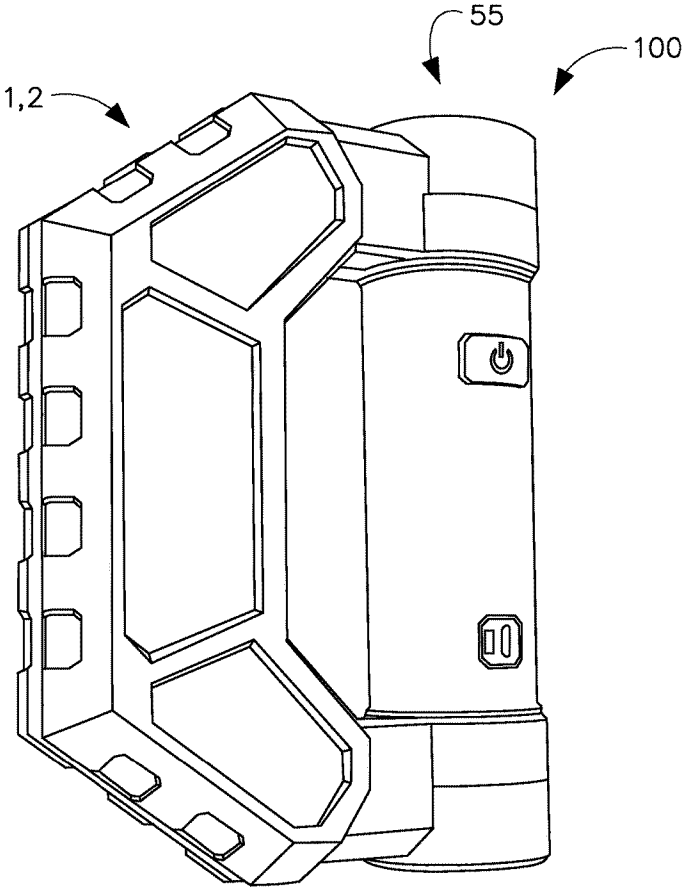
Figure 1D:
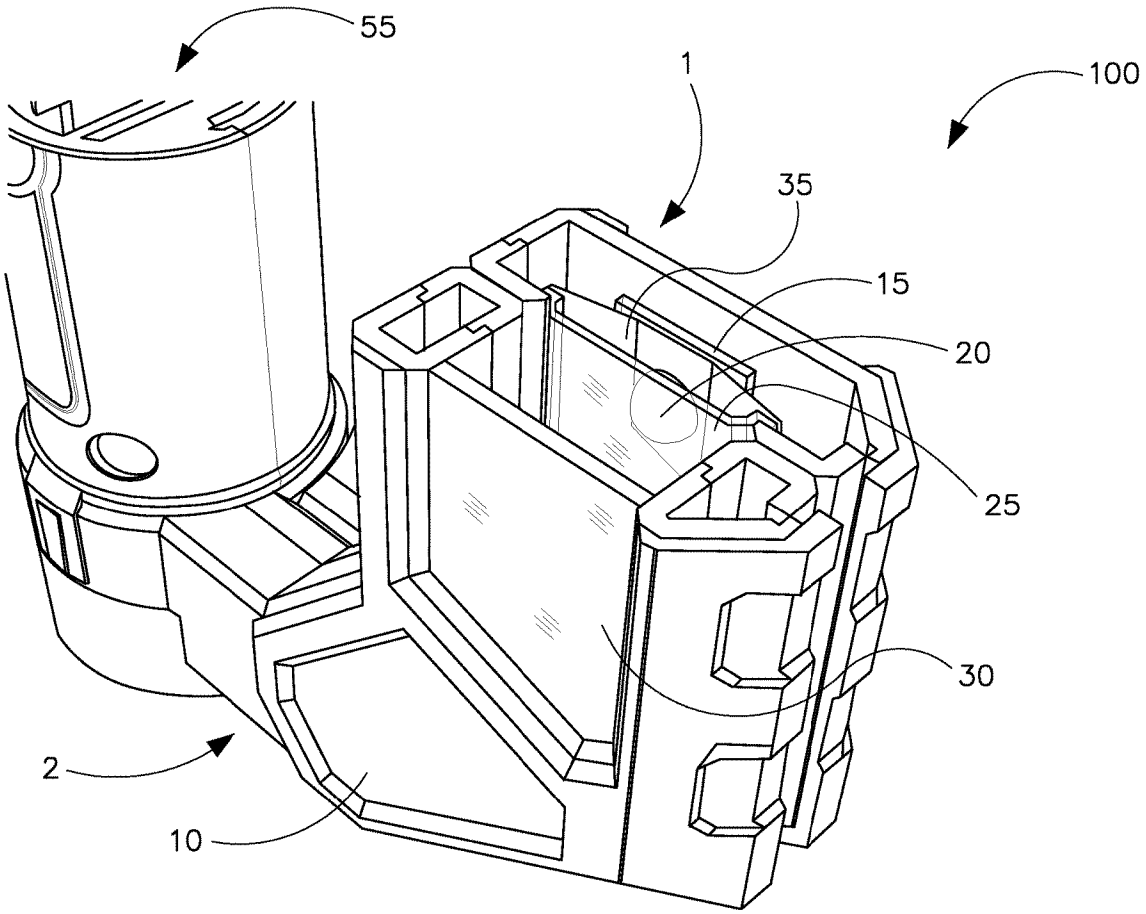

In the closed configuration, which is illustrated in FIGS. 1B, 1C, and 1D, the arms 1, 2 swing together. As best seen in FIG. 1D, with the arms 1, 2 rotated together, the light that passes through the clear lens 25 from the middle portion of the arm 1 is incident upon a diffusing lens 30 in the arm 2 that scatters or diffuses transmitted light. Similarly and as discussed in further detail below with reference to FIG. 3, the light that emits from the light emitting diodes 15 in the top and bottom portions of the arm 2 is incident upon and is softened by a diffusing lens 30 in the arm 1.

Accordingly, the light that emits from the portable light 100 with the arms 1, 2 closed is relatively diffuse and may be suited for illuminating a relatively broad space, for example a room, a basement under construction, a picnic area, or a campsite. In the illustrated embodiment, the portable light 100 further comprises reflective tape 100 that can reflect light from vehicular headlamps for safety, for example.

Referring now to FIG. 2, multiple views of the portable light 200 are provided in accordance with another example embodiment. FIG. 2A illustrates a perspective view of the portable light 200 in an open configuration. FIGS. 2B and 2C respectively illustrate front and back views of the portable light 200 in the open configuration. FIGS. 2D and 2E respectively illustrate opposing side views of the portable light 200 in the open configuration. FIGS. 2F and 2G illustrate opposing top and bottom views of the portable light 200 in the open configuration.

Figure 2A:
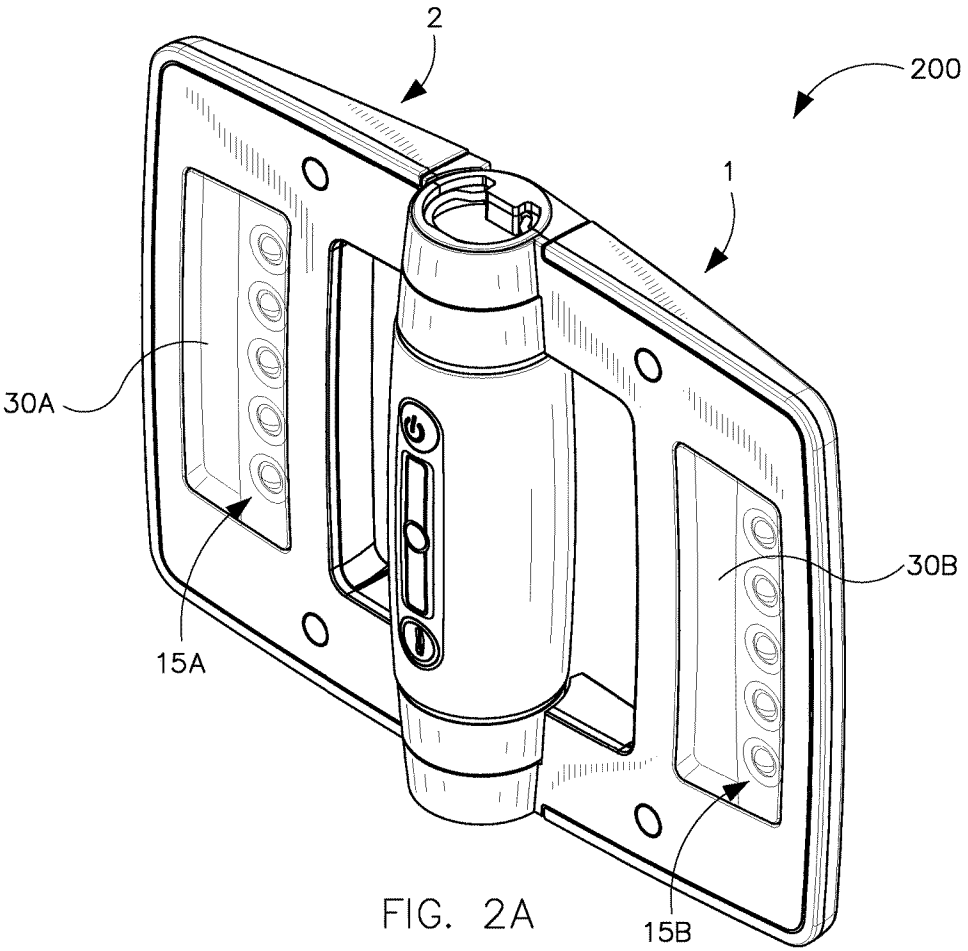
FIGS. 2A, 2B, 2C, 2D, 2E, 2F, and 2G (collectively FIG. 2) illustrate another example portable light in accordance with some embodiments of the disclosure.
Figure 2B:
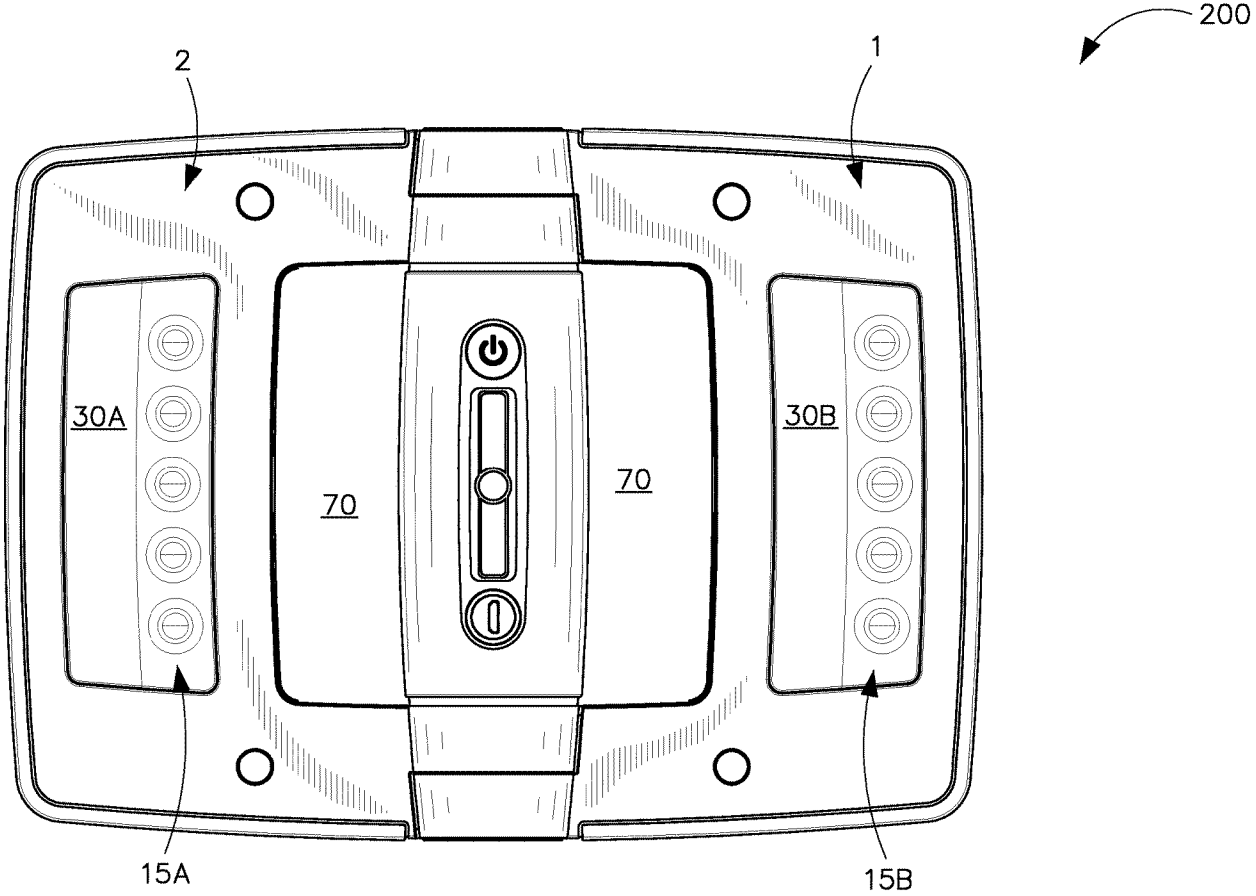
Figure 2C:
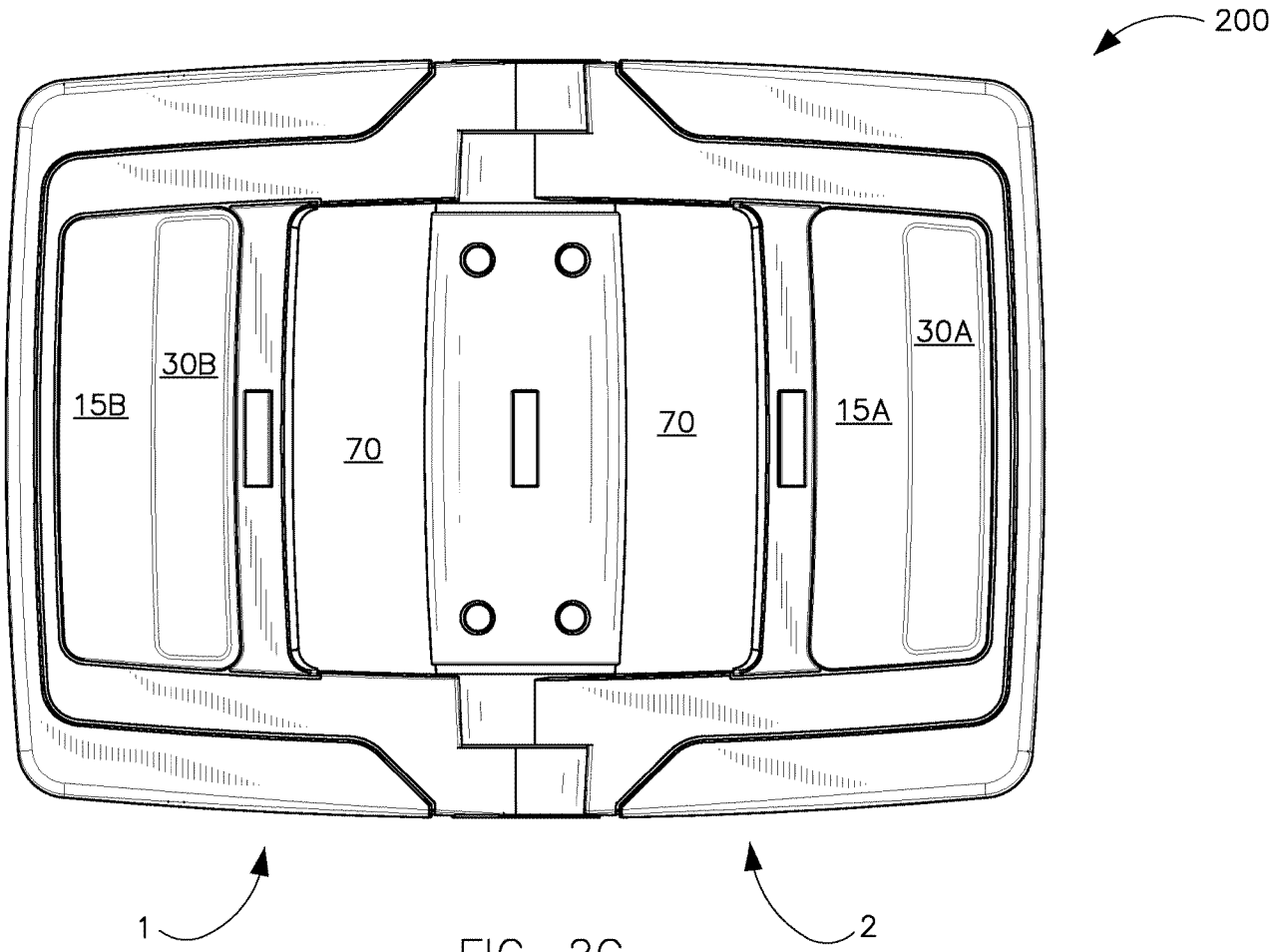
Figure 2E:
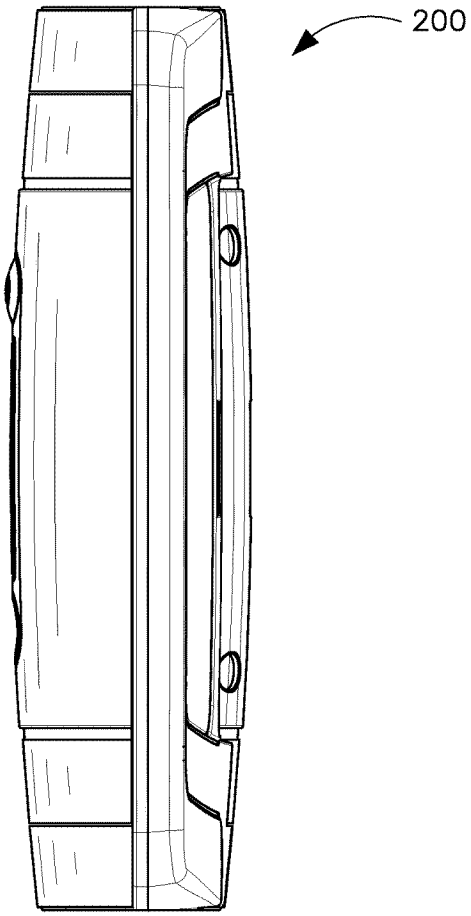
Figure 2D:
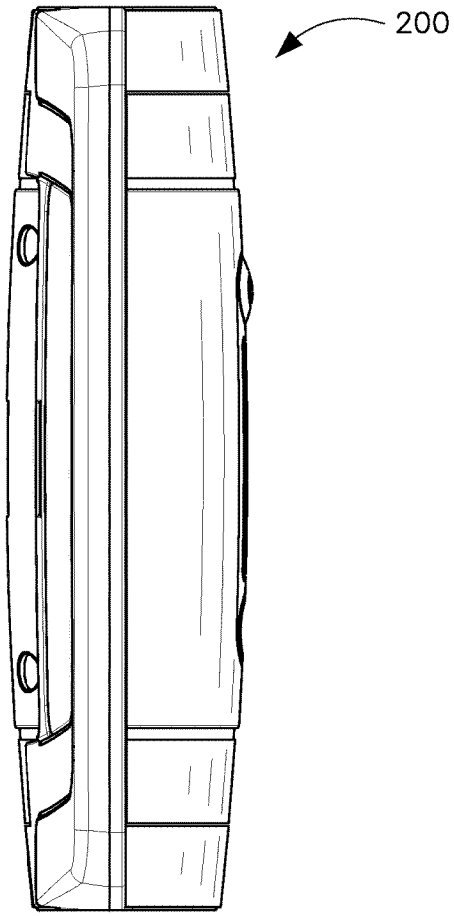
Figure 2F:
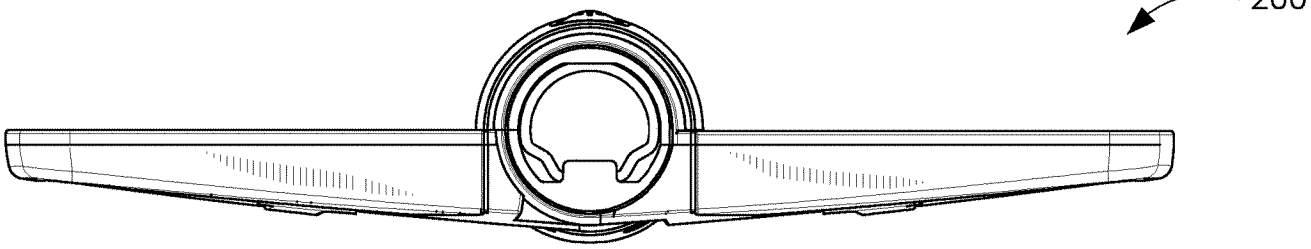
Figure 2G:
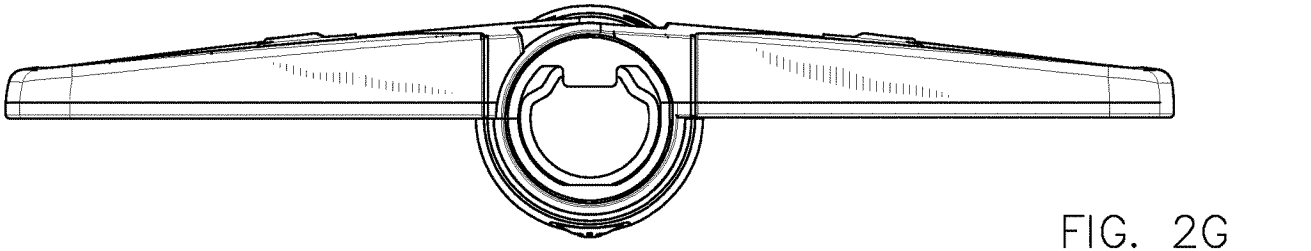

As best seen FIGS. 2A, 2B, and 2C, each rotatable arm 1, 2 of the portable light 200 comprises a respective array of light emitting diodes 15A, 15B and a respective diffusing lens 30A, 30B. In the arm 2, the light emitting diodes 15A are closer to the axis of arm rotation than in the arm 1, and the diffusing lens 30A is farther from the axis. When the arms 1, 2 are closed (as discussed above with reference to FIG. 1), the light emitting diodes 15B in the arm 1 emit light into (and through) the diffusing lens 30A in the arm 2. Similarly, the light emitting diodes 15A in the arm 2 emit light into (and through) the diffusing lens 30B in the arm 1. Thus, the emitted light is diffused when the arms 1, 2 are closed.

In the open configuration illustrated in FIG. 2, the light produced by the two arrays of light emitting diodes 15 emits from the portable light 200 without passing through either diffusing lens 30A, 30B and thus provides a relatively concentrated, projecting illumination pattern. As discussed above, the portable light 200 can accordingly produce multiple, user-selected patterns of illumination for different applications and situations.

As best seen in FIGS. 2B and 2C, in addition to providing two optical configurations, the rotating arms 1, 2 provide an opening 70 that may be sized to receive a user's hand to facilitate carrying and handling of the portable light 200. In the illustrated embodiment, the opening 70 is available for the user's hand in both the opened and closed configurations.

Figures 3, 3A:
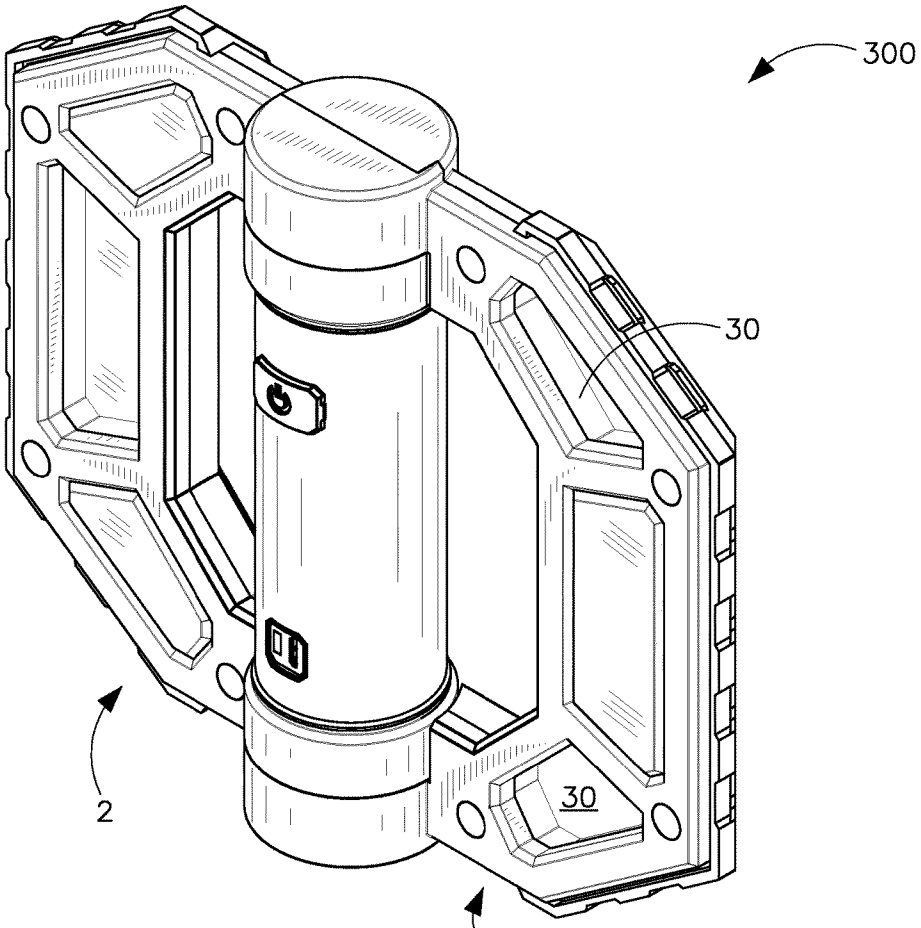
FIGS. 3A, 3B, 3C, and 3D (collectively FIG. 3) illustrate another example portable light in accordance with some embodiments of the disclosure.
Figure 3B:
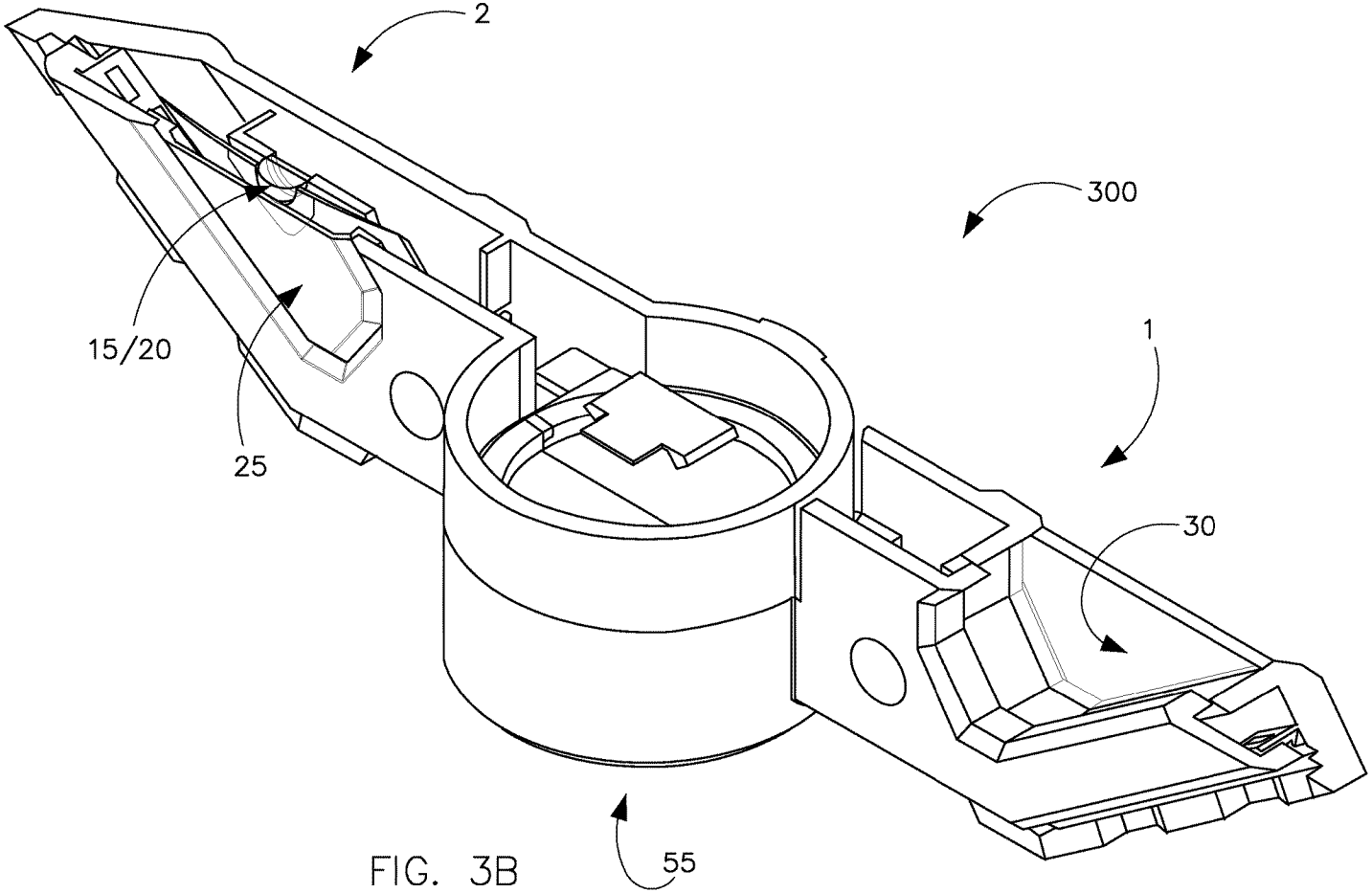
Figure 3C:
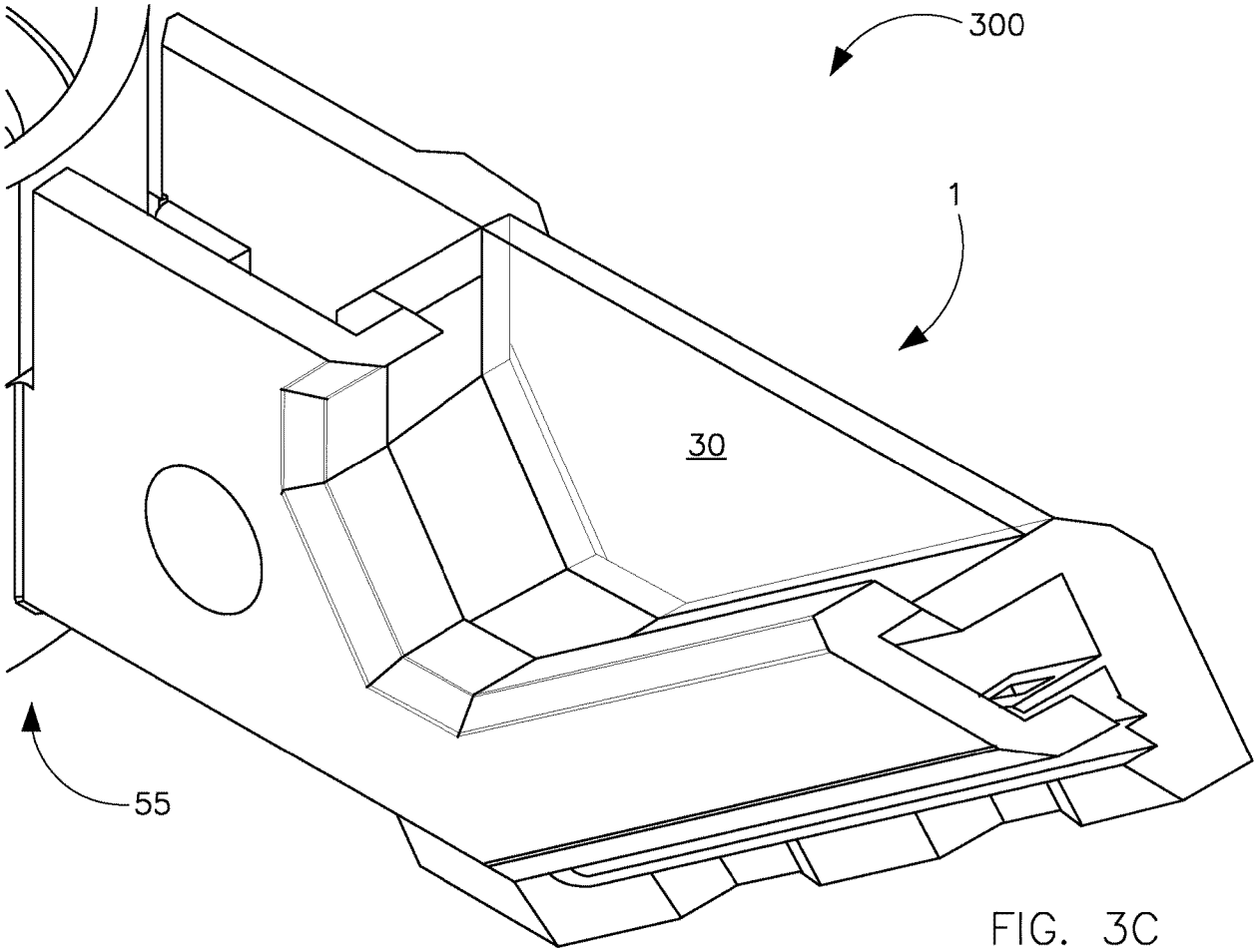
Figure 3D:
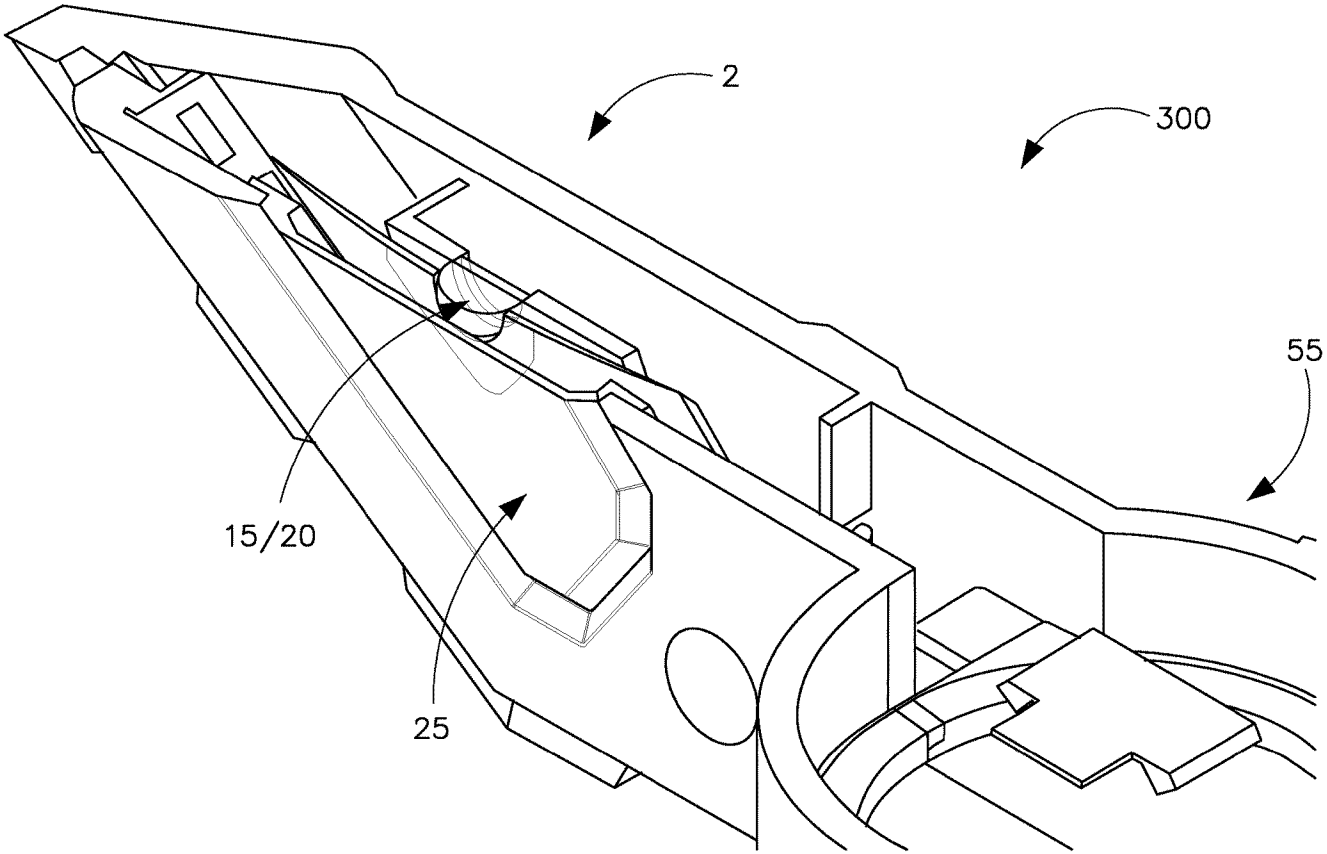

Referring now to FIG. 3, multiple views of the portable light 300 are provided. FIG. 3A illustrates a perspective view of the portable light 300 in an open configuration. FIG. 3B illustrates a perspective cutaway view of the portable light 300 in the open configuration, showing both arms 1, 2 in cutaway. FIG. 3C illustrates a magnified cutaway view of one of the arms 1 of the portable light 300, while FIG. 3D illustrates a magnified cutaway view of the other arm 2. As discussed above, in some example embodiments, the features illustrated in the portable light 300 of FIG. 3 can be incorporated into the portable light 100 of FIG. 1, and vice versa.

As best seen in the cutaway view of FIG. 3B and in the magnified cutaway of FIG. 3D, the portable light 300 comprises light emitting diodes 15 and associated focusing optical elements 20 in the upper and lower sections of the arm 2. With the arms 1, 2 open, light produced by each light emitting diode 15 in the arm 2 is condensed, focused, or collimated by the associated focusing optical element 20 in the arm 2 and then emits through the associated clear lens 25 of the arm 2. When the user swings the arms 1, 2 closed, the diffusing lens 30 in the arm 1 moves into the path of the condensed light passing through the clear lens 25. In this configuration, the diffusing lens 30 thus diffuses the light, resulting in relatively soft light useful for reading, task illumination, or other application benefiting from diffuse illumination.

Accordingly, the portable light 300 can produce light that diverges differently according to whether the portable light 300 is opened or closed. In some example embodiments, the diffusing lens 30 snaps in and out so that a user can readily remove and replace it. For example, the user can swap the diffusing lens 30 for a colored filter, which may diffuse light in some embodiments, or transmit light without diffusion in other embodiments. In some example embodiments, the clear lens 20 snaps in and out for removal and replacement by the user. The user may readily swap a clear version of the lens 20 for one that is colored to filter light, for example.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A lighting system comprising:

a first member comprising:

a first light source operable to emit first light; and a first light diffusing element; and a second member comprising:

a second light source operable to emit second light; and a second light diffusing element;

wherein the first member is moveable relative to the second member to provide at least a first position and a second position, wherein in the first position, the first light exits the lighting system from the first member without substantial incidence on the second light diffusing element to generate a first illumination pattern and the second light exits the lighting system from the second member without substantial incidence on the first light diffusing element to generate the first illumination pattern, wherein in the second position, the first light exits the lighting system from the second member by passing through the second light diffusing element to generate a second illumination pattern and the second light exits the lighting system from the first member by passing through the first light diffusing element to generate the second illumination pattern, and wherein the first illumination pattern is different from the second illumination pattern.

2. The lighting system of claim 1, further comprising a central member about which at least one of the first member and the second member rotate to provide the first position and the second position.

3. The lighting system of claim 2, wherein the central member comprises a battery enclosure.

4. The lighting system of claim 3, wherein the central member is sized for holding by hand.

5. The lighting system of claim 1, wherein the first light source comprises at least one light emitting diode and the second light source comprises at least one other light emitting diode.

6. The lighting system of claim 5, wherein the first light source further comprises a first focusing lens and the second light source further comprises a second focusing lens.

7. The lighting system of claim 1, wherein in the first position, the first light emits from the lighting system without incidence on the first light diffusing element and the second light emits from the lighting system without incidence on the second light diffusing element.

8. The lighting system of claim 1, wherein the first light diffusing element and the second light diffusing element are user changeable with respective filters.

9. A portable light comprising:

a central portion;

a first arm that extends from the central portion, the first arm being rotatable about the central portion and comprising:

a first aperture;

a first set of light emitting diodes (LEDs) disposed in the first aperture; and a first optic disposed in the first aperture at a first position that is adjacent to and offset relative to the first set of LEDs; and a second arm that extends from the central portion, the second arm being rotatable about the central portion and comprising:

a second aperture;

a second set of LEDs disposed in the second aperture; and a second optic disposed in the second aperture at a second position that is adjacent to and offset relative to the second set of LEDs, wherein the portable light is user changeable between a first configuration and a second configuration, wherein when the portable light is changed from the first configuration to the second configuration where the first arm faces the second arm: (a) the first optic in the first aperture of the first arm is disposed in front of the second set of LEDs in the second aperture of the second arm such that light emitted by the second set of LEDs exits the portable light from the first arm by passing through the first optic to generate an illumination pattern, (b) and the second optic in the second aperture of the second arm is disposed in front of the first set of LEDs in the first aperture of the first arm such that light emitted by the first set of LEDs exits the portable light from the second arm by passing through the second optic to generate the illumination pattern.

10. The portable light of claim 9, further comprising a compartment in the central portion that is sized to receive a battery for powering the first set of LEDs and the second set of LEDs.

11. The portable light of claim 9, wherein the first optic comprises a first light diffusing element, and wherein the second optic comprises a second light diffusing element.

12. The portable light of claim 9, wherein the first optic comprises a first filter, and wherein the second optic comprises a second filter.

13. The portable light of claim 9, further comprising:

a first refractive lens disposed in front of the first set of LEDs; and a second refractive lens disposed in front of the second set of LEDs.

14. A lighting system comprising:

a frame that comprises a first member and a second member;

a first light emitting diode mounted to the first member;

a first optic mounted to the first member;

a second light emitting diode mounted to the second member;

a second optic mounted to the second member, wherein at least one of the first and second members is movable relative to the other of the first and second members so as to move the first optic in front of the second light emitting diode such that light emitted by the second light emitting diode exits the lighting system from the first member by passing through the first optic in the first member and the second optic in front of the first light emitting diode such that light emitted by the first light emitting diode exits the lighting system from the second member by passing through the second optic in the second member.

15. The lighting system of claim 14, wherein the first optic comprises a first diffusing lens, and wherein the second optic comprises a second diffusing lens.

16. The lighting system of claim 14, wherein the frame further comprises a central portion, wherein the first member extends from the central portion, and wherein the second member extends from the central portion.

17. The lighting system of claim 14, wherein the frame further comprises a central portion, wherein the first member comprises a first arm that extends from the central portion and that is rotatable about the central portion, and wherein the second member comprises a second arm that extends from the central portion and that is rotatable about the central portion.

18. The lighting system of claim 14, wherein the lighting system comprises a portable light.

19. The lighting system of claim 14, wherein the first optic comprises a first filter, and wherein the second optic comprises a second filter.

* * * * *